US008960740B2

(12) United States Patent
Huang et al.

(10) Patent No.: US 8,960,740 B2
(45) Date of Patent: Feb. 24, 2015

(54) LOCK SHELL ASSEMBLY

(71) Applicant: Tong Lung Metal Industry Co., Ltd., Chiayi (TW)

(72) Inventors: Tsung-Chung Huang, Chaiyi (TW); Chia-Min Sun, Chaiyi (TW); Ju-Lin Yang, Chaiyi (TW); Yu-Ting Huang, Chaiyi (TW)

(73) Assignee: Tong Lung Metal Industry Co., Ltd., Chiayi (TW)

( * ) Notice: Subject to any disclaimer, the term of this patent is extended or adjusted under 35 U.S.C. 154(b) by 113 days.

(21) Appl. No.: 13/801,954

(22) Filed: Mar. 13, 2013

(65) Prior Publication Data

US 2013/0241216 A1 Sep. 19, 2013

(30) Foreign Application Priority Data

Mar. 15, 2012 (TW) ..... 101204663 U

(51) Int. Cl.

| | |
|---|---|
| ***E05B 1/00*** | (2006.01) |
| ***E05B 9/00*** | (2006.01) |
| ***E05B 3/06*** | (2006.01) |
| *E05B 15/02* | (2006.01) |

(52) U.S. Cl.

CPC ..... *E05B 9/002* (2013.01); *E05B 3/065* (2013.01); *E05B 15/02* (2013.01)

USPC ..... 292/347; 292/348; 292/357

(58) Field of Classification Search

CPC ..... E05B 15/02

USPC ..... 292/347, 348, 350, 351, 354, 357

See application file for complete search history.

(56) References Cited

U.S. PATENT DOCUMENTS

| | | | | | |
|---|---|---|---|---|---|
| 794,779 | A * | 7/1905 | Caley et al. | ..... | 292/357 |
| 936,441 | A * | 10/1909 | Franklin | ..... | 292/349 |
| 1,653,513 | A * | 12/1927 | Schlage | ..... | 292/357 |
| 2,423,206 | A * | 7/1947 | Schlage | ..... | 292/357 |
| 2,454,754 | A * | 11/1948 | Netschert | ..... | 292/359 |
| 2,702,720 | A * | 2/1955 | Young | ..... | 292/357 |
| 3,677,593 | A * | 7/1972 | Wahlberg | ..... | 292/356 |
| 4,869,083 | A * | 9/1989 | DeMarseilles et al. | ..... | 70/224 |
| 5,248,175 | A * | 9/1993 | Burns | ..... | 292/347 |
| 5,284,373 | A * | 2/1994 | Watson | ..... | 292/347 |
| 6,048,007 | A * | 4/2000 | Shor | ..... | 292/348 |
| 7,475,925 | B2 * | 1/2009 | Huang et al. | ..... | 292/347 |
| 2009/0146439 | A1 * | 6/2009 | Watts et al. | ..... | 292/350 |

FOREIGN PATENT DOCUMENTS

| | | | | |
|---|---|---|---|---|
| DE | 3245181 A1 * | 6/1984 | ..... | E05B 15/02 |
| EP | 193081 A2 * | 9/1986 | ..... | E05B 3/06 |

* cited by examiner

*Primary Examiner* — Carlos Lugo

(74) *Attorney, Agent, or Firm* — Chun-Ming Shih

(57) ABSTRACT

A shell assembly includes a first shell having an elastic joint component securely formed on a side face of the first shell, a second shell received in the first shell having a concavity to correspondingly partially receive therein the joint component, such that the first shell and the second shell are separably connected together for a replacement application.

9 Claims, 3 Drawing Sheets

LOCK SHELL ASSEMBLY

CROSS-REFERENCE TO RELATED APPLICATION

This application claims the priority of Taiwanese Utility Model Application, No. 101204663, filed on Mar. 15, 2012, the disclosure of which is herein incorporated by reference.

BACKGROUND OF THE INVENTION

1. Field of the Invention

This invention is related to a shell assembly for a lock, where the shell assembly is separable to provide an interchangeability of the appearance covering the lock.

2. Description of the Related Art

For door decoration, the region of latch bolt is an important part to concern. That is, whenever there is a need to change the lock, the entire lock mechanism as well as the appearance of the lock assembly is also changed. People often use a shell configured to the position where a latch bolt mechanism is exposed, so as to make the door stylish in appearance. For that purpose, there are many shells of different appearances provided in the market for multiple decorative applications.

However, in conventional application, the shell is firmly attached to the latch bolt or the door with irremovable configuration, and it is hard to dismantle the shell because the shell is not separably designed. It may take a lot of cost, such as money and time, to change the latch bolt shell.

SUMMARY OF THE INVENTION

The purpose of the present invention is to provide a separable shell structure which enables the aforementioned shell outside the lock to be easily removed and replaced.

According to one aspect of the present invention, a shell assembly comprises: a first shell having an elastic joint component securely formed on a side face of the first shell and a cavity defined therein; and a second shell received in the cavity of the first shell and having a concavity defined in a periphery thereof to correspond to and partially engage therein the joint component, such that the first shell and the second shell are separably connected together due to resilience provided by the joint component.

According to another aspect of the present invention, a shell assembly comprises: a rectangular-shaped first shell having at least one elastic joint component securely formed on a side face of the first shell and a cavity defined therein, where the side face has at least one protruding component; and a disc-shaped second shell received in the cavity of the first shell and having at least one concavity defined in a periphery thereof to correspond to and partially receive and engage therein the joint component, at least one aperture defined on the second shell to correspond to and receive the protruding component of the first shell, such that the first shell and the second shell are separably connected together due to the resilience provided by the joint component.

According to still another aspect of the present invention, a shell assembly comprises: a rectangular-shaped first shell having two elastic joint components respectively and securely formed in diagonal corners of the rectangular-shaped first shell and a cavity defined therein, wherein a side face of the first shell has two protruding components; and a disc-shaped second shell received in the cavity of the first shell and having two concavities defined in a periphery thereof to correspond to and partially receive therein the joint components, two apertures defined on the second shell to correspond to and receive the protruding components of the first shell, such that the first shell and the second shell are separably connected together due to the resilience provided by the joint components, wherein the first shell further includes two accepting parts to respectively allow fasteners to secure the joint components thereon the accepting parts, and the second shell has two guiding elements defined to correspond to the joint components of the first shell, and the concavities are defined to be adjacent to the guiding elements to facilitate entrance of the joint components in the concavities respectively.

BRIEF DESCRIPTION OF THE DRAWINGS

The invention, as well as its many advantages, may be further understood by the following detailed description and drawings in which.

DETAILED DESCRIPTION OF THE INVENTION

Figure 1:
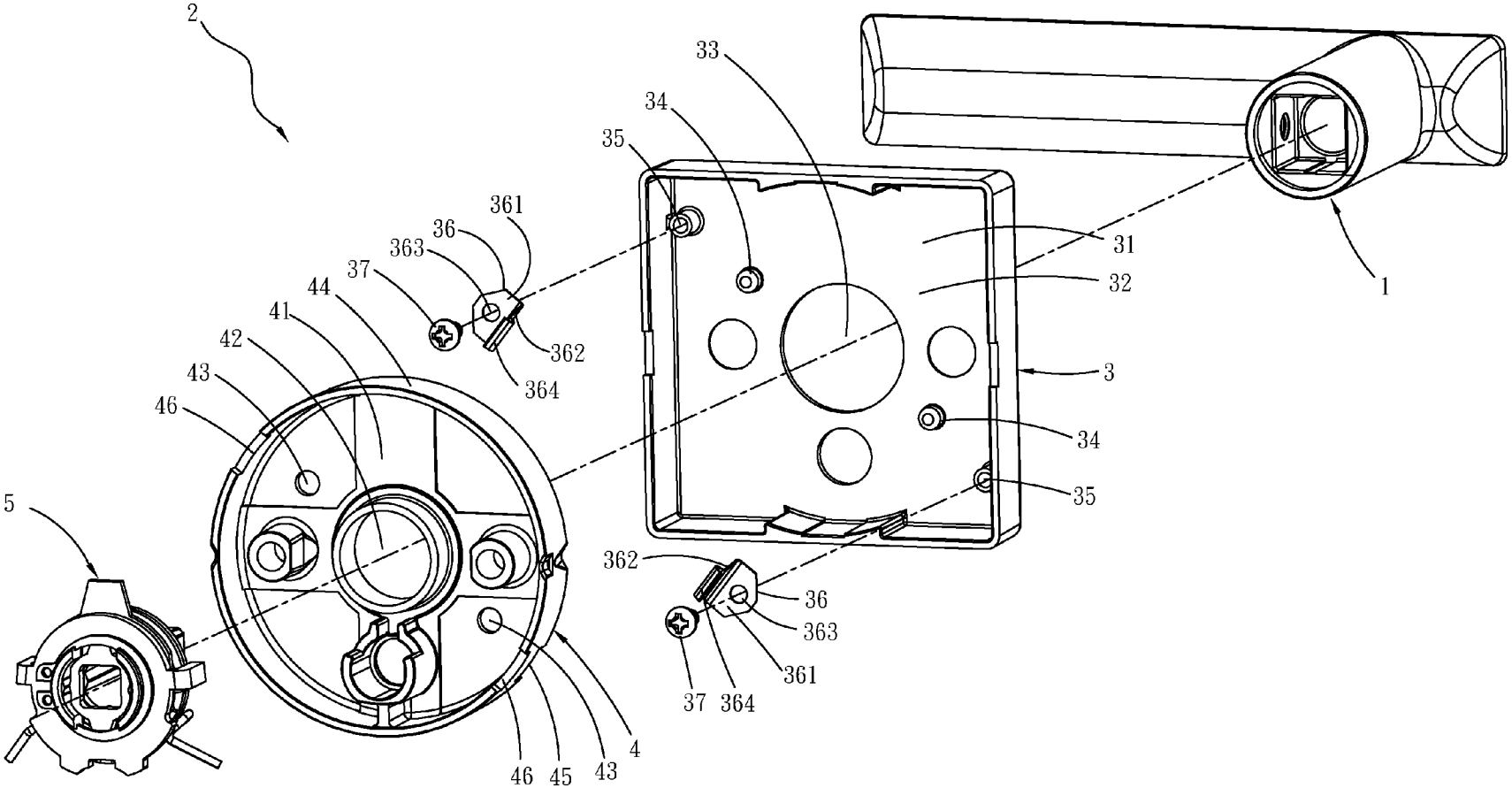
FIG. 1 is an exploded perspective view illustrating a shell assembly of the preferred embodiment of the present invention, wherein a handle and an elastic mechanism constructed in accordance with the present invention are shown.

FIG. 1 illustrates a preferred embodiment of the invention, in which a shell assembly 2 is used to cover an elastic mechanism 5, where the elastic mechanism 5 is connected to a handle 1 penetrating the shell assembly 2 and a lock mechanism (not shown), such that the lock mechanism is functional by operating the handle 1, and the lock mechanism (such as a latch bolt), is able to anchored into a door or other lock apparatuses.

The shell assembly 2 of the preferred embodiment of the present invention comprises a first shell 3 and a second shell 4, wherein the first shell 3 includes: a plate 31, a cavity 32 defined in the plate 31 of the first shell 3, a centrally defined hole 33 penetrating the plate 31 to provide a channel for extension of the handle 1 and the elastic mechanism 5, at least two protruding components 34 formed near corners of the plate 31, at least two accepting components 35 formed near the corners of the plate 31 for insertion of a fastener 37 individually, and at least two joint components 36 respectively having a second hole 363 defined to allow the fastener 37 to penetrate therethrough in order to enable the joint components 36 to be positioned on the first shell 3 individually. Here, the fastener 37 is selected from a group consisted of a screw, a rivet, a clasp and a buckle.

Figure 2:
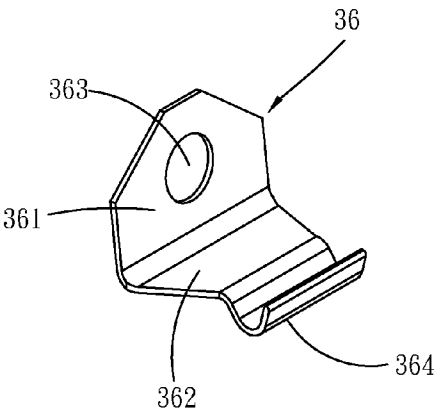
FIG. 2 is a perspective view of a joint component of the present invention.

With the reference of FIG. 2, the joint component 36 is a tortuous body composed of a first plate 361, a second plate 362 integrally formed with the first plate 361 and an arc 364 extending from a distal peripheral edge of the second plate 362, wherein the second hole 363 is defined in the first plate 361. Moreover, the joint component 36 is made of an elastic material, such that the joint component 36 is resilient.

Referring back to the FIG. 1, the second shell 4 includes: a second plate 41, a third hole 42 penetrating the second plate 41 to correspond to the hole 33 of the first shell 3, at least two apertures 43 penetrating the plate 41 and individually corresponding to the protruding components 34 of the first shell 3, a ring 44 surrounding the second plate 41 to form a space for receiving therein the elastic mechanism 5, at least two guiding elements 45, e.g. track or a slanted surface in the preferred embodiment, configured to the outside of the ring 44 and positioned correspondingly to the joint components 36 individually, and a concavity 46 (or a groove) defined near a distal end of each of the guiding elements 45. The second shell 4 is able to attach to the door to cover the exposed elastic mechanism 5 and the aforementioned lock mechanism. It is to be noted that in this embodiment of the present invention, the track 45 is a recessed area to guide movement of the arc 364.

Figure 3:
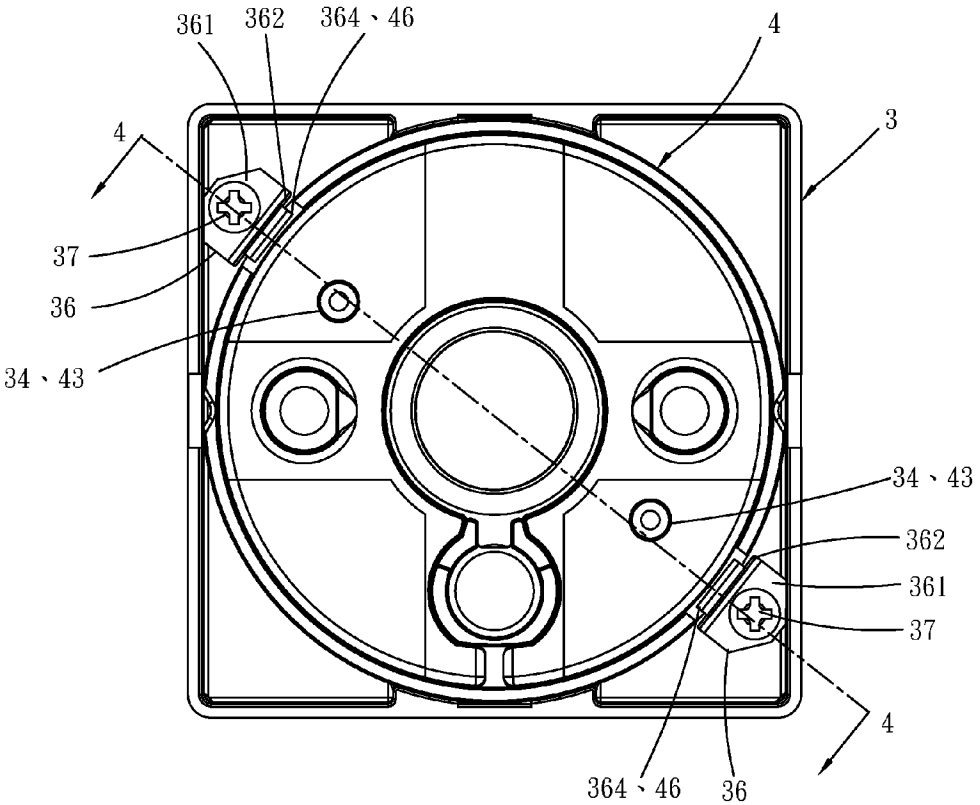
FIG. 3 is a plan view of the combination of the shell assembly of the preferred embodiment of the present invention.
Figure 4:
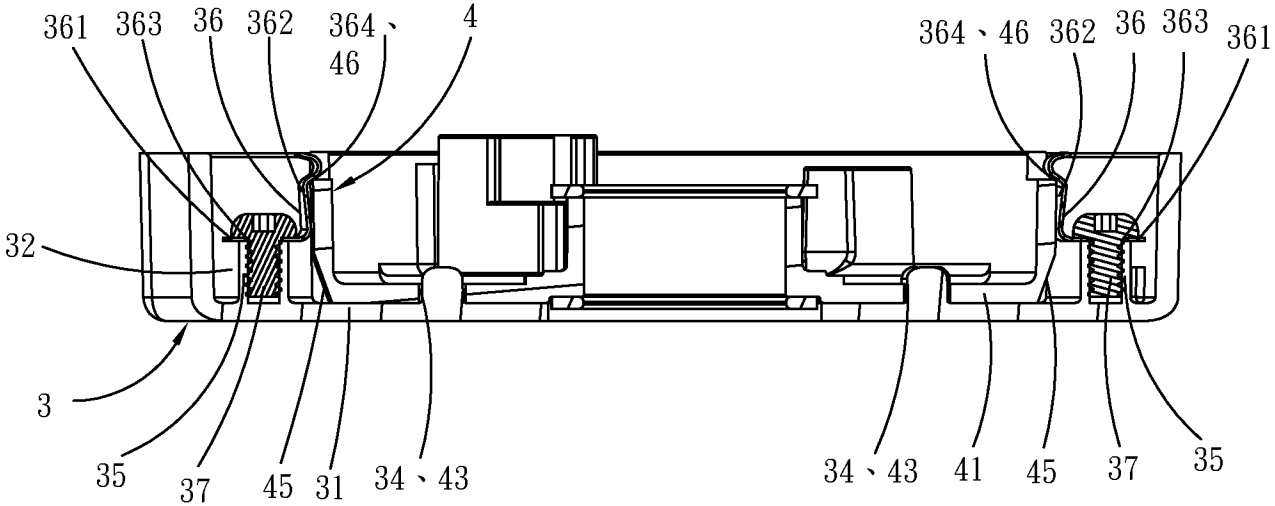
FIG. 4 is a cross-sectional view of the shell assembly of the present invention, according to line 4-4 indicated in FIG. 3.

For the purpose of easy description of the preferred embodiment of the present invention, the following description focuses on the function and operation of a single element when there are two identical elements involved. Here, the size of the second plate 41 is smaller than that of the first plate 31 of the first shell 3, such that the second shell 4 is able to be received in the cavity 32 of the first shell 3. After the second shell 4 is received in the cavity 32 of the first shell 3, the joint component 36 is able to slide into the guiding element 45 (the track or a slanted surface) so as to allow the arc 364 to be received and engaged therein the concavity 46 which is defined near a distal end of the track 45. Thus, the first shell 3 is capable of conjointly combing with the second shell 4 (as shown in FIG. 3 and FIG. 4) and optionally removing from the second shell 4, via the joint components 36 which is resilient to be unstuck from the concavity 46.

In this preferred embodiment, as shown in FIG. 1, the plate 31 is in rectangular shape, thus the first shell 3 appears rectangular shape from the direction of the handle 1. However, the first shell 3 is able to be removed from the second shell 4 in a simple way because the joint component 36 is resilient. There are many options for the shapes or styles of the first shell 3 to be applied for decorative applications.

For another preferred embodiment, the joint component 36 is able to be securely connected to the first shell 3 via riveting.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A shell assembly comprising:

a rectangular-shaped first shell having at least one elastic joint component securely formed on a side face of the first shell and a cavity defined therein, where the side face has at least one protruding component, wherein the joint component is composed of a first plate, a second plate formed with the first plate and an arc extending from the second plate; and a disc-shaped second shell received in the cavity of the first shell and having a surrounding ring formed with at least one concavity defined on a peripheral edge thereof to correspond to and partially receive and engage therein the joint component, at least one aperture defined on the second shell to correspond to and receive the protruding component of the first shell, wherein the second shell has at least one guiding element formed on a side opposite to the peripheral edge, which is defined to correspond to the joint component of the first shell, and the concavity is defined near a distal end of the guiding element to facilitate the arc of the joint component to engage with the concavity under guidance of the guiding element, such that the first shell and the second shell are separably connected together due to the resilience provided by the joint component.

2. The shell assembly of claim 1, wherein the guiding element is a track or a slanted surface.

3. The shell assembly of claim 2, wherein the arc of the joint component is received in the concavity to allow the first shell to be combined with the second shell.

4. The shell assembly of claim 3, wherein the joint component is securely formed in a corner of the rectangular-shaped first shell.

5. A shell assembly comprising:

a rectangular-shaped first shell having two elastic joint components respectively and securely formed in diagonal corners of the rectangular-shaped first shell and a cavity defined therein, wherein a side face of the first shell has two protruding components, and each joint component is composed of a first plate, a second plate formed with the first plate and an arc extending from the second plate; and a disc-shaped second shell received in the cavity of the first shell and having a surrounding ring formed with two concavities defined on a peripheral edge thereof to correspond to and partially receive therein the joint components, two apertures defined on the second shell to correspond to and receive the protruding components of the first shell, such that the first shell and the second shell are separably connected together due to the resilience provided by the joint components, wherein the first shell further includes two accepting parts to respectively allow fasteners to secure the joint components thereon the accepting parts, and the second shell has two guiding elements formed on a side opposite to the peripheral edge, which are defined to correspond to the joint components of the first shell respectively, and the concavities are defined to be adjacent to the guiding elements to facilitate the arcs of the joint components to engage with the concavities under guidance of the guiding elements respectively.

6. The shell assembly of claim 5, wherein the guiding element is a track or a slanted surface.

7. The shell assembly of claim 6, wherein the arcs of the joint components are respectively received in the concavities to allow the first shell to be combinable with the second shell.

8. The shell assembly of claim 7, wherein the fastener is selected from a group consisted of a screw, a rivet, a clasp and a buckle.

9. The shell assembly of claim 8, wherein the accepting parts are formed in corners of the rectangular-shaped first shell.

* * * * *